US008095051B2

(12) United States Patent
Katayama

(10) Patent No.: US 8,095,051 B2
(45) Date of Patent: Jan. 10, 2012

(54) IMAGE FORMING APPARATUS WHICH ACHIEVES STABILITY OF A GAP BETWEEN AN IMAGE BEARING MEMBER AND DEVELOPER BEARING MEMBER

(75) Inventor: Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 456 days.

(21) Appl. No.: 12/207,893

(22) Filed: Sep. 10, 2008

(65) Prior Publication Data

US 2009/0074449 A1 Mar. 19, 2009

(30) Foreign Application Priority Data

Sep. 19, 2007 (JP) ..... 2007-242235

(51) Int. Cl.
*G03G 15/06* (2006.01)

(52) U.S. Cl. ..... 399/279

(58) Field of Classification Search ..... 399/279, 399/267, 265

See application file for complete search history.

(56) References Cited

U.S. PATENT DOCUMENTS

| | | | | |
|---|---|---|---|---|
| 5,208,634 | A | | 5/1993 | Ikemoto et al. |
| 5,294,960 | A | | 3/1994 | Nomura et al. |
| 5,294,967 | A | | 3/1994 | Munakata et al. |
| 5,470,635 | A | | 11/1995 | Shirai et al. |
| 5,608,509 | A | | 3/1997 | Shirai et al. |
| 5,623,328 | A | | 4/1997 | Tsuda et al. |
| 5,659,847 | A | | 8/1997 | Tsuda et al. |
| 5,669,042 | A | | 9/1997 | Kobayashi et al. |
| 5,682,579 | A | | 10/1997 | Nomura et al. |
| 5,828,928 | A | | 10/1998 | Sasago et al. |
| 5,828,929 | A | | 10/1998 | Watanabe et al. |
| 5,907,749 | A | | 5/1999 | Nomura et al. |
| 5,987,278 | A | | 11/1999 | Nomura et al. |
| 6,118,961 | A | | 9/2000 | Nomura et al. |
| 6,157,794 | A | * | 12/2000 | Katsumi et al. ..... 399/53 |
| 2007/0036591 | A1 | * | 2/2007 | Okabe et al. ..... 399/279 |
| 2008/0317513 | A1 | * | 12/2008 | Sakagawa et al. ..... 399/281 |

FOREIGN PATENT DOCUMENTS

| | | | |
|---|---|---|---|
| JP | 01093774 | A * | 4/1989 |
| JP | 02083563 | A * | 3/1990 |
| JP | 3-67279 | A | 3/1991 |
| JP | 05232752 | A * | 9/1993 |
| JP | 6-282122 | A | 10/1994 |

(Continued)

OTHER PUBLICATIONS

Computer Translation for JP09-106184A, Apr. 22, 1997.*

*Primary Examiner* — Quana M Grainger
(74) *Attorney, Agent, or Firm* — Fitzpatrick, Cella, Harper & Scinto

(57) ABSTRACT

An image forming apparatus has an abutment roller which is provided at either end of a developing sleeve in a longitudinal direction and makes an SD gap (Gsd) between a photosensitive drum and a developing sleeve constant, an abutment block which is provided at either end of the photosensitive drum in a longitudinal direction and on which the abutment roller abuts, and a pressing spring which directly presses the abutment roller toward the abutment block. The stability of the SD gap (Gsd) and reduction of the driving load torque of the developing sleeve can be achieved to cope with both high image quality and durability of the image forming apparatus.

3 Claims, 8 Drawing Sheets

FOREIGN PATENT DOCUMENTS

| | | | | |
|---|---|---|---|---|
| JP | 9-34256 | A | | 2/1997 |
| JP | 09096937 | A | * | 4/1997 |
| JP | 09106184 | A | * | 4/1997 |
| JP | 09152826 | A | * | 6/1997 |
| JP | 11-15269 | A | | 1/1999 |
| JP | 11-24398 | A | | 1/1999 |
| JP | 2000298397 | A | * | 10/2000 |
| JP | 2004-54208 | A | | 2/2004 |

* cited by examiner

PRIOR ART

PRIOR ART

IMAGE FORMING APPARATUS WHICH ACHIEVES STABILITY OF A GAP BETWEEN AN IMAGE BEARING MEMBER AND DEVELOPER BEARING MEMBER

BACKGROUND OF THE INVENTION

1. Field of the Invention

The present invention relates to an image forming apparatus, such as a copying machine and a laser beam printer, which allows an electrostatic latent image on a latent image bearing member to be a visible image by a development device.

2. Description of Related Art

As illustrated in FIGS. 7 and 8, an image forming apparatus typically has a photosensitive drum 1 and a development device 3. The development device 3 has a developing sleeve 12. The photosensitive drum 1 and the developing sleeve 12 are arranged so as to constantly hold an SD gap Gsd which is a small gap between the photosensitive drum 1 and the developing sleeve 12, thereby performing predetermined development. When the SD gap Gsd is varied, poor image formation such as inconsistencies in density in an image can be caused.

The developing sleeve 12 has an abutment roller 20 at either end in a longitudinal direction so as to be rotatably held via a bearing 24, and is rotatably supported by a developing case 22 via a bearing 21. The developing sleeve 12 has at one end a gear 23 which provides the driving force of rotation to the developing sleeve 12. The driving force is inputted from the outside of the development device 3. The SD gap Gsd is ensured by the abutment roller 20 which is provided at either end of the developing sleeve 12 and a to-be-abutted portion.

The abutment roller 20 abuts on the outer circumferential surface of the photosensitive drum 1 as the to-be-abutted portion. The developing sleeve 12 is arranged so as to hold the predetermined SD gap Gsd.

The abutment roller 20 needs to be rotated following the photosensitive drum so as to prevent frictional sliding of the surface of the photosensitive drum 1 and the abutment roller 20. The abutment roller 20 is thus rotatably held by the developing sleeve 12. The development device is pressed to indirectly press the abutment roller 20 onto the photosensitive drum 1. To abut the abutment roller 20 on the circumferential surface of the photosensitive drum 1, the base end of a spring 18 is attached to the rear side of the developing case 22. The end of the spring 18 is supported by a fixing plate 19 which is provided in the image forming apparatus body. The development device 3 is pressed toward the photosensitive drum 1 by a horizontal force.

The abutment roller 20 is provided via the bearing 24 so as to be rotated with the photosensitive drum 1 on which the abutment roller 20 abuts. The inner circumference of the bearing 24 is rotated with the developing sleeve 12.

The development device 3 can be detached by removing the fixing plate 19 so as to be slid along guide members 13 and 14 when the used developing sleeve 12 needs to be maintained.

As illustrated in FIGS. 9 and 10, the abutment roller 20 abuts on an abutment block 16 which has a high-precision surface S provided so as to be concentric with the photosensitive drum 1. The developing sleeve 12 is arranged so as to hold the predetermined SD gap Gsd.

The development device 3 is vibrated when the driving force is inputted from the outside. Variation in the SD gap Gsd caused by the vibration can be reduced by increasing the spring force of the spring 18 (see Japanese Patent Application Laid-Open No. 11-15269).

When the spring force is increased in the image forming apparatus of the related art, the radial load of the bearing 21 which receives the developing sleeve 12 and the radial load of the bearing 24 of the abutment roller 20 are increased, thereby deteriorating the durability of both the bearings.

As illustrated in FIG. 11, when the abutment force of the abutment roller 20 on the abutment block 16 is F [N], the force of the spring 18 also needs F [N]. When the bearing 21 is integrally held by the developing case 22, the bearing 21 is sandwiched between the spring force and the developing sleeve 12 to receive the radial load of F1 [N] (F=F1).

When the bearing 24 is integral with the abutment roller 20, the bearing 24 is sandwiched between the abutment block 16 and the developing sleeve 12 to receive the radial load of F2 [N] (F=F2).

The increased radial load leads to increase in the torque of the developing sleeve 12. The vibration of the development device 3 at transmission of the driving force can deteriorate the durability of the gears of the driving train. The increased torque of the developing sleeve 12 can increase rotational variation of the developing sleeve 12 due to engagement per tooth of the developing driving train. Inconsistencies in pitch appear on an image.

SUMMARY OF THE INVENTION

The present invention provides an image forming apparatus which can achieve stability of an SD gap and reduction of the driving load torque of a developing sleeve and cope with both high image quality and durability.

An image forming apparatus to achieve the above object has the following.

An image forming apparatus has:

an image bearing member;

a development device which has a rotatable developer bearing member;

a fixing member which is fixedly arranged on either side of the image bearing member in a rotational axis direction;

an abutment member which is rotatably provided on the rotational axis of the developer bearing member and abuts on the fixing member to form a gap between the image bearing member and the developer bearing member; and a pressing device which directly presses the abutment member so that the abutment member presses the fixing member.

Further features of the present invention will become apparent from the following description of exemplary embodiments (with reference to the attached drawings).

DESCRIPTION OF THE EMBODIMENTS

Embodiment

Figure 1:
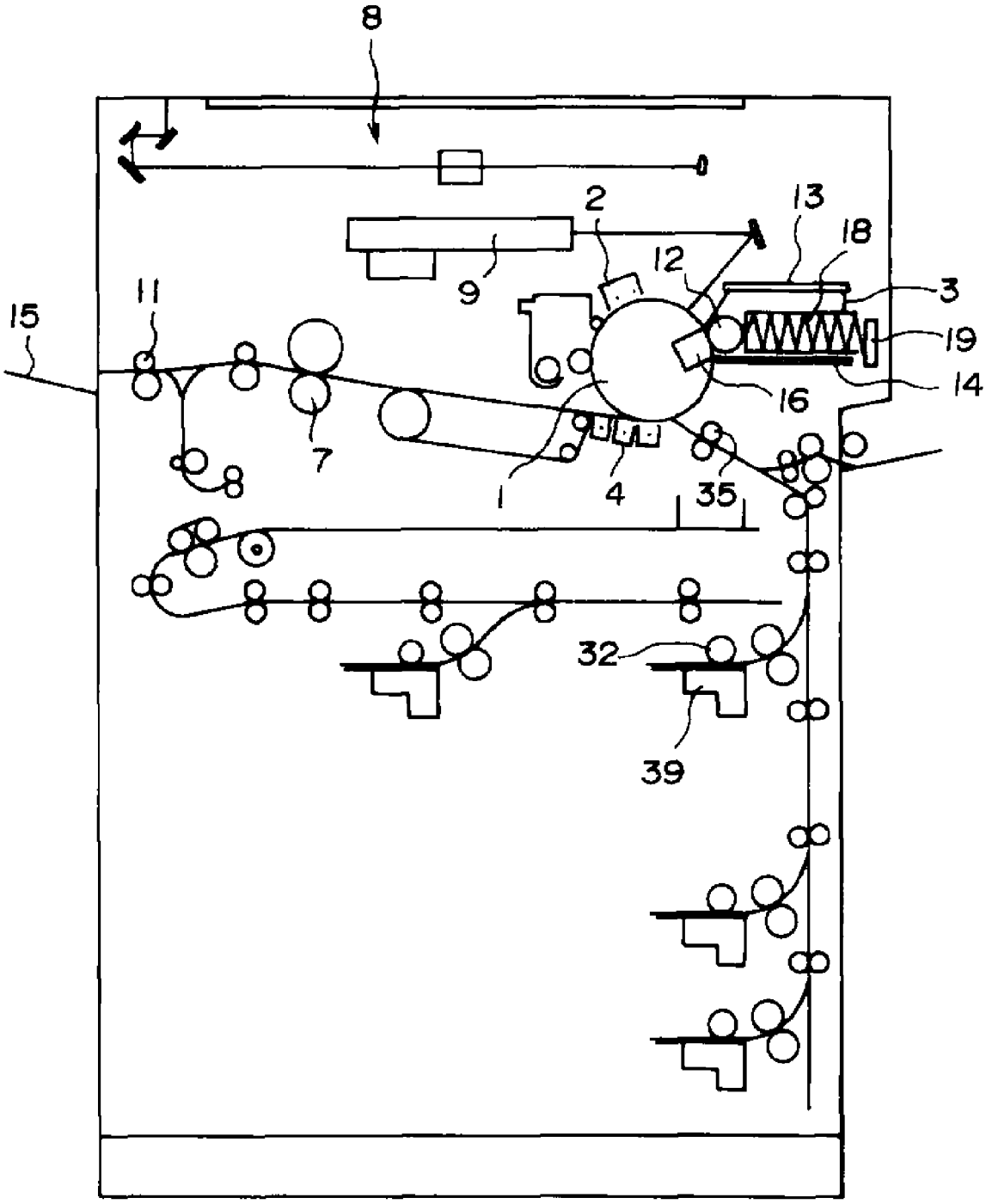
FIG. 1 is a block diagram of an image forming apparatus according to an embodiment of the present invention.
Figure 2:
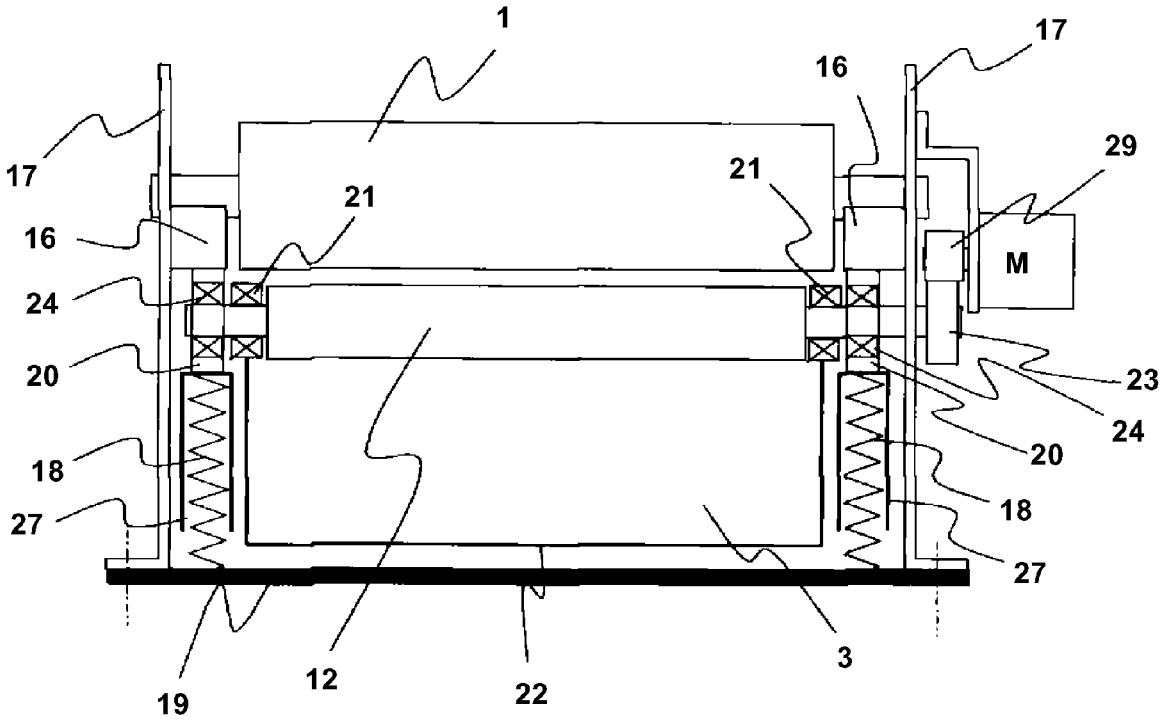
FIG. 2 is a schematic plan view of a photosensitive drum and a development device illustrated in FIG. 1.
Figure 3:
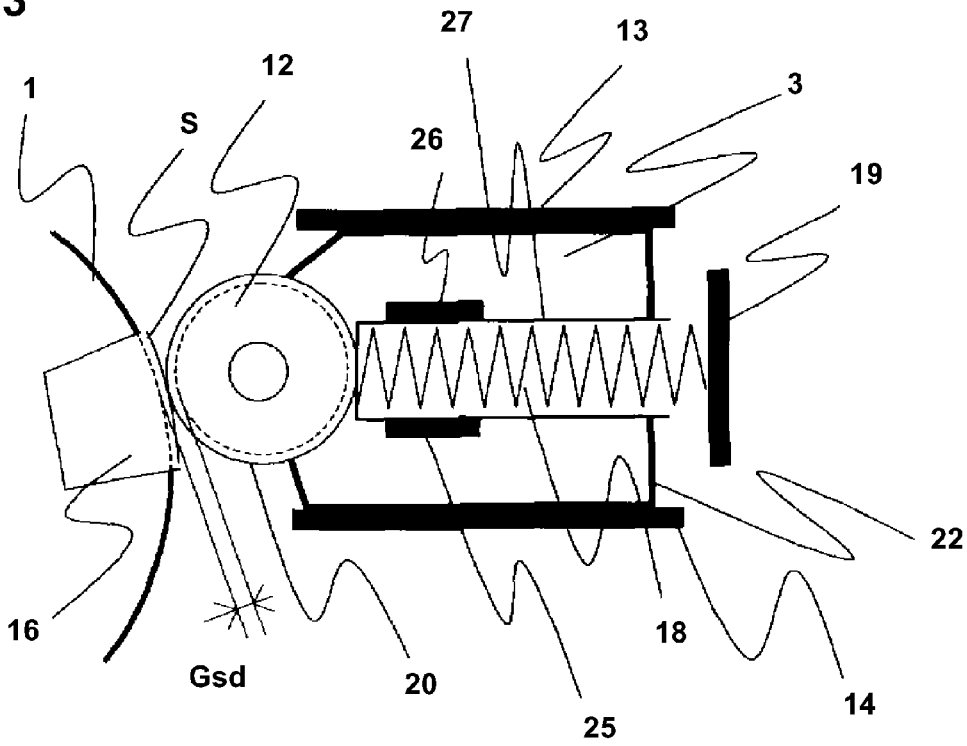
FIG. 3 is a cross-sectional view of FIG. 2.

An embodiment of the present invention will be described below in detail based on the drawings. The same components as the related art are indicated by the same reference numerals. FIG. 1 illustrates a block diagram of an image forming apparatus according to an embodiment of the present invention. FIG. 2 is a schematic plan view of a photosensitive drum and a development sleeve. FIG. 3 is a cross-sectional view of FIG. 2.

In FIGS. 1 to 3, the image forming apparatus reads the image of an original by an image reading portion 8. The surface of a photosensitive drum 1 as an image bearing member is exposed by an image writing portion 9 by an instruction from a controller (not illustrated) based on the read image data.

Before exposure, the surface of the photosensitive drum 1 is uniformly charged to a predetermined potential by a charger 2. The uniformly charged photosensitive drum 1 is illuminated with a laser beam by the image writing portion 9. An electrostatic latent image is formed on the photosensitive drum 1.

The electrostatic latent image formed on the photosensitive drum 1 is developed by providing toner as a developer by a development device 3. The developed toner image is conveyed to the opposite portion from a transfer device 4 by rotation of the photosensitive drum 1.

Corresponding to the conveying of the developed toner image, each sheet 39 is fed from a sheet cassette (not illustrated) by a pickup roller 32 and is then conveyed to the opposite portion of the photosensitive drum 1 from the transfer device 4 by a pair of registration rollers 35 with timing. When the sheet 39 passes through the opposite portion of the photosensitive drum 1 from the transfer device 4, the toner image on the photosensitive drum 1 is transferred onto the sheet 39 by the transfer device 4.

The sheet 39 onto which the toner image is transferred is conveyed to a pair of fixing rollers 7 by a predetermined conveying apparatus, is press-contacted by the pair of fixing rollers 7, and is heated by a heater (not illustrated) provided in the pair of fixing rollers 7.

The toner on the sheet 39 is meltingly fixed to the sheet 39. The sheet 39 to which the toner image is fixed is stored in a tray 15 outside the image forming apparatus body by a discharge roller 11.

The photosensitive drum 1 is rotatably held by a side plate 17 via a bearing (not illustrated). An abutment block 16 which has a high-precision surface S is arranged at either end of the photosensitive drum 1 in a longitudinal direction. The abutment block 16 is fixed to the side plate 17. The high-precision surface S is formed into a curved surface which is concentric with the surface of the photosensitive drum 1.

The development device 3 has a developing case 22 which stores toner, and a cylindrical developing sleeve 12 which is rotatably held by the developing case 22 via a bearing 21 and is a developer bearing member. A thin layer of the born toner having a uniform thickness is formed on the surface of the developing sleeve 12.

An abutment roller (gap ensuring member) 20 is rotatably provided at either end of the developing sleeve 12 in a longitudinal direction via a bearing 24. A gear 23 is provided a tone end of the developing sleeve 12. A driving source 29 which is coupled to the gear 23 is fixed to the side plate 17. The developing sleeve 12 is rotationally driven by the driving source 29.

The abutment roller 20 abuts on the high-precision surface S (abutted surface) of the abutment block 16 to determine an SD gap Gsd which is a gap between the photosensitive drum 1 and the developing sleeve 12, and is the so-called gap ensuring member. The high-precision surface S is provided so as to be concentric with the surface of the photosensitive drum 1. When the abutment roller 20 whose position is slightly changed abuts on the high-precision surface S, the SD gap Gsd is held constant.

The abutment roller 20 is pressed onto the high-precision surface S of the abutment block 16 by the urging force of a spring 18. The spring 18 has one end fixed to a fixing plate 19, and the other end fixed in a spring holder 27. The end of the spring holder 27 abuts on the abutment roller 20. The fixing plate 19 is fixed to the side plate 17. The spring 18 and the spring holder 27 configure a pressing unit. The pressing unit directly presses the abutment roller 20 (gap ensuring member).

The force of the spring 18 is transmitted to the abutment roller 20 via the spring holder 27. The abutment roller 20 is pressed onto the abutment block 16. When the developing sleeve 12 is maintained, the development device 3 can be detached by removing the fixing plate 19 from the side plate 17. The development device 3 is slid along guide members 13 and 14 which are arranged on the upper and lower sides thereof in a detaching direction.

Spring holder guides 25 and 26 are arranged on the upper and lower sides of the spring holder 27. The spring holder 27 is held by the spring holder guides 25 and 26 so that it is slid in a direction pressing the abutment roller 20 onto the abutment block 16.

Figure 4:
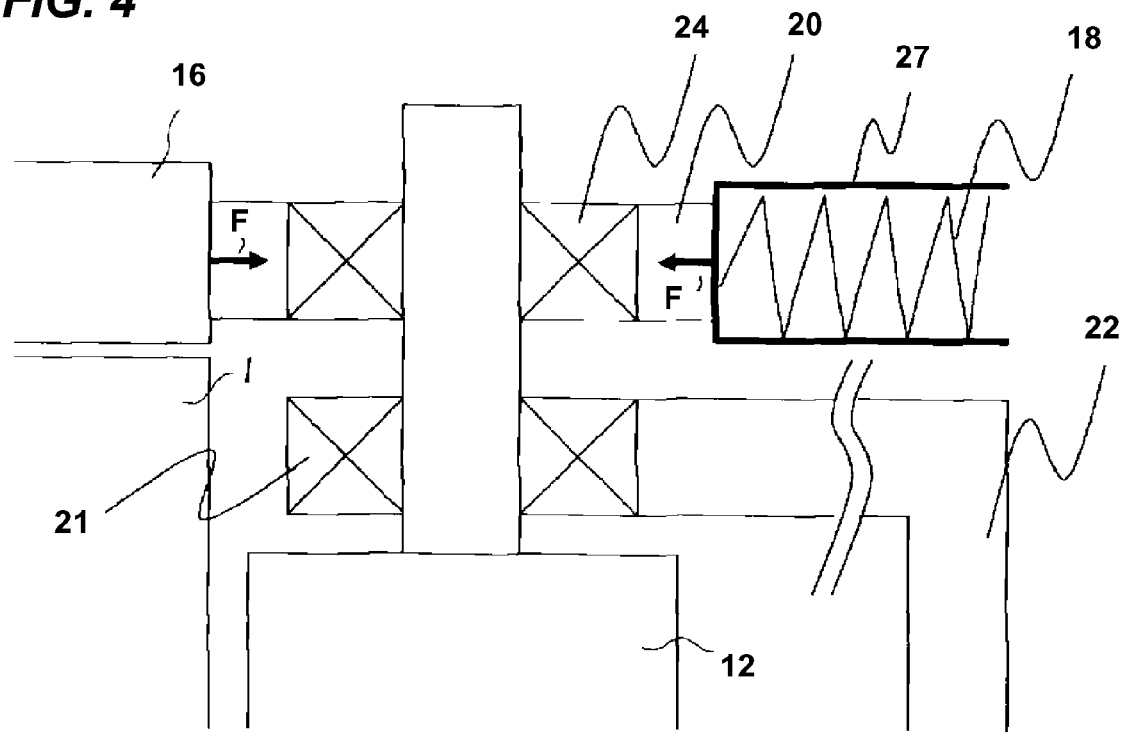
FIG. 4 is a diagram describing operating forces of FIG. 2.

In this embodiment, as illustrated in FIG. 4, the abutment roller 20 is sandwiched between the abutment block 16 and the spring holder 27. The position of the developing sleeve 12 is stable. Only the abutment roller 20 receives a load.

The abutment forces do not act as the radial loads of the bearings 21 and 24. When the force of the spring 18 is increased, increase in the rotation load of the developing sleeve 12 and lowering of the durability of the bearings 21 and 24 can be prevented.

In this embodiment, the abutment roller 20 abuts on the abutment block 16. The present invention is not limited to this. The abutment roller 20 may directly abut on the photosensitive drum 1.

Other embodiment

Figure 5:
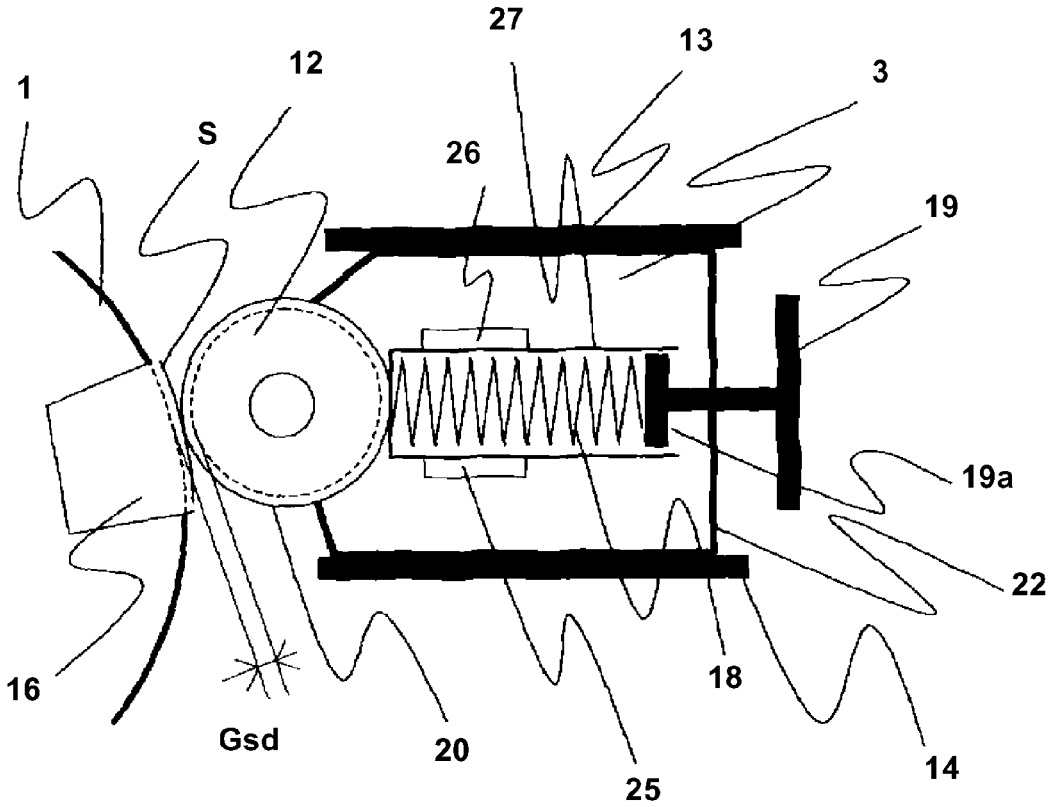
FIG. 5 is a cross-sectional view of the development device according to another embodiment of the present invention.

Another embodiment is illustrated in FIG. 5. The development device 3 has the spring 18, the spring holder 27, and the spring holder guides 25 and 26. The spring holder 27 may be supported so as to be slid with respect to the developing case 22. A protrusion 19*a* of the fixing plate 19 may press the spring 18 so that the abutment roller 20 can press the abutment block 16.

Figure 6:
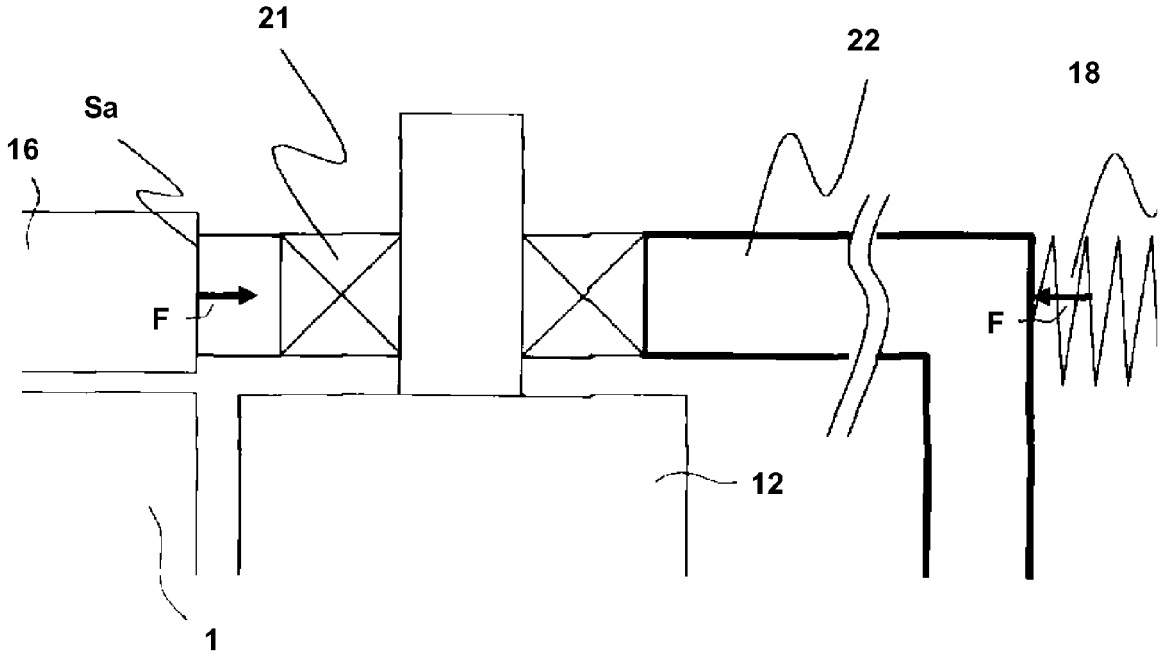
FIG. 6 is a diagram describing operating forces of the development device according to another embodiment of the present invention.
Figure 7:
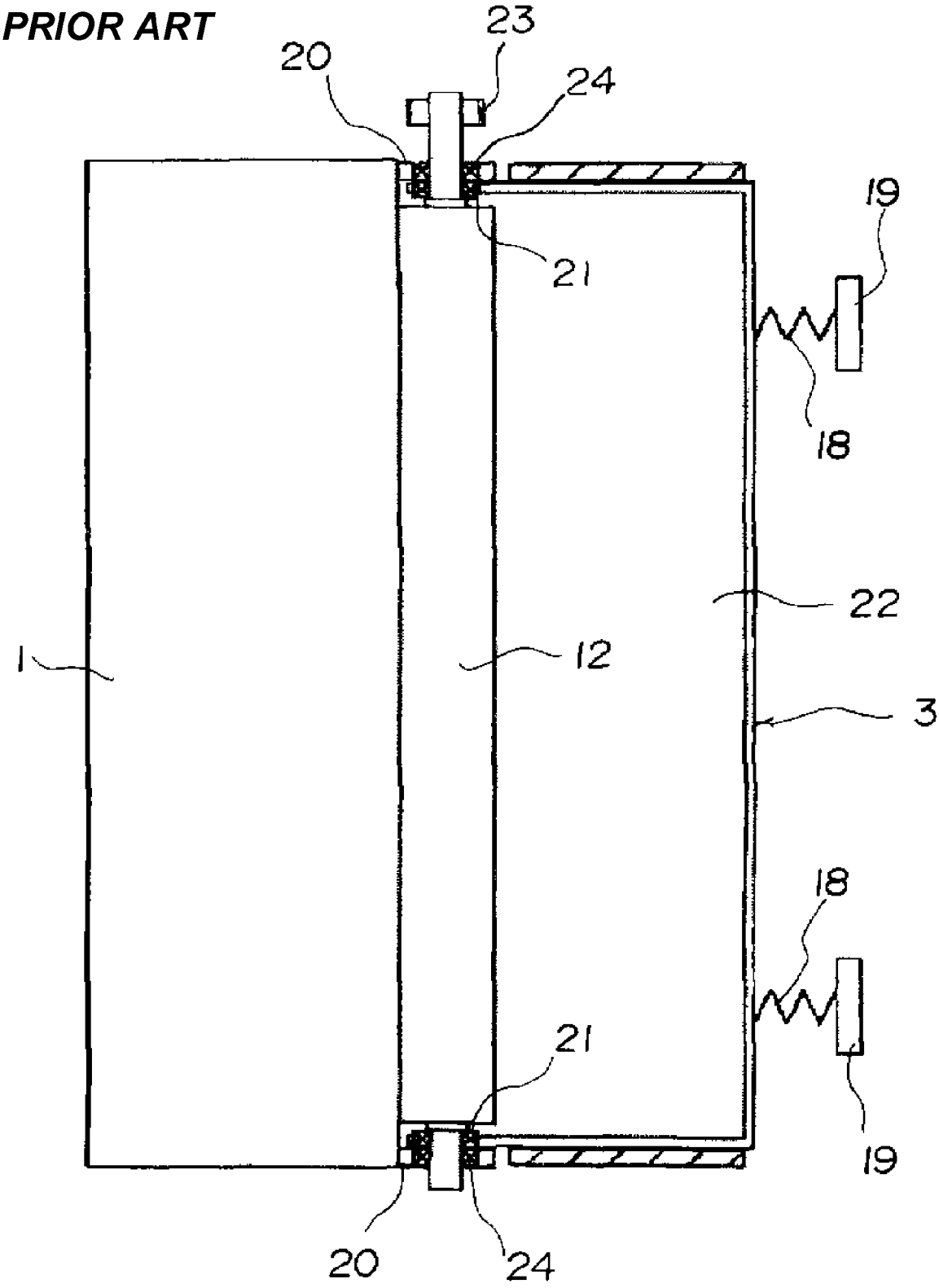
FIG. 7 PRIOR ART
FIG. 7 is a schematic plan view of the photosensitive drum and the development device of an image forming apparatus of a related art.
Figure 8:
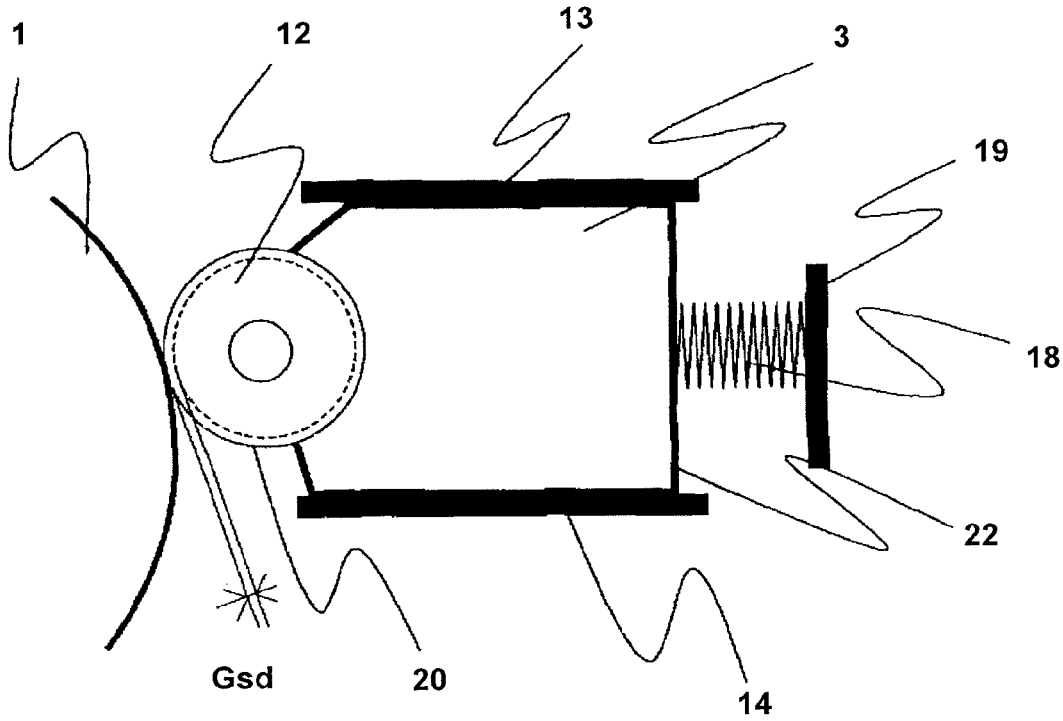
FIG. 8 is a cross-sectional view of FIG. 7.
Figure 9:
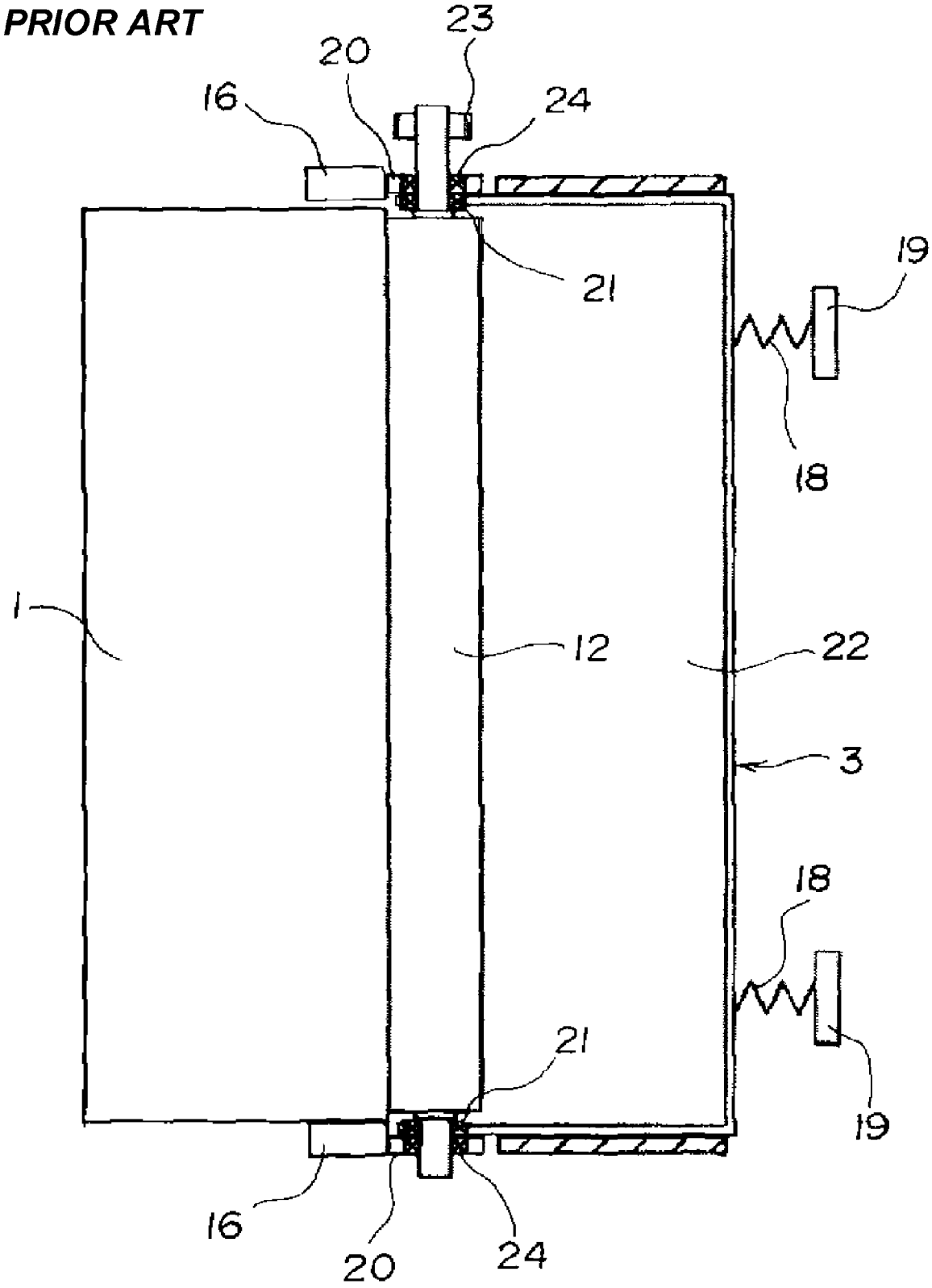
FIG. 9 PRIOR ART
FIG. 9 is a schematic plan view of the photo sensitive drum and the development device of another image forming apparatus of the related art.
Figure 10:
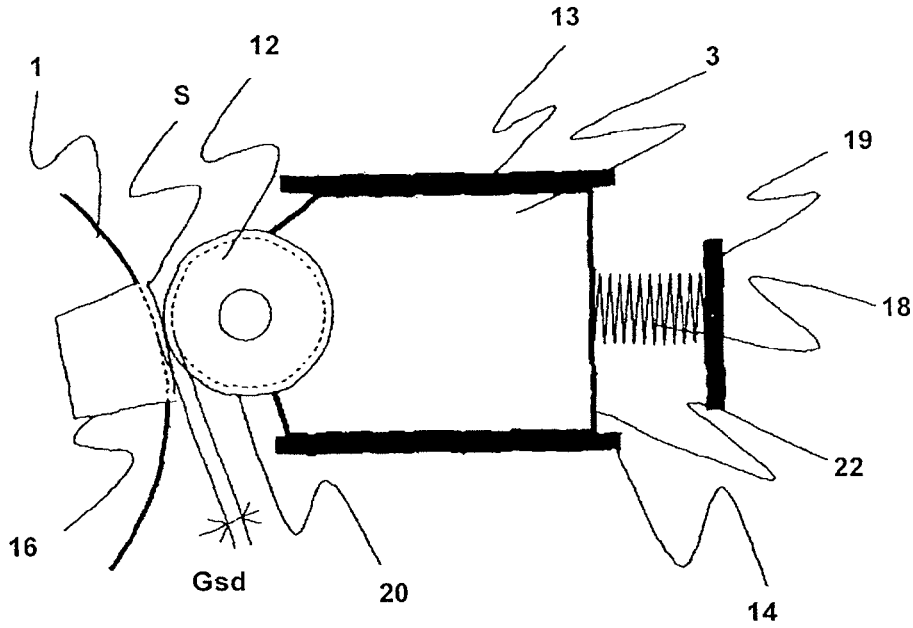
FIG. 10 is a cross-sectional view of FIG. 9.
Figure 11:
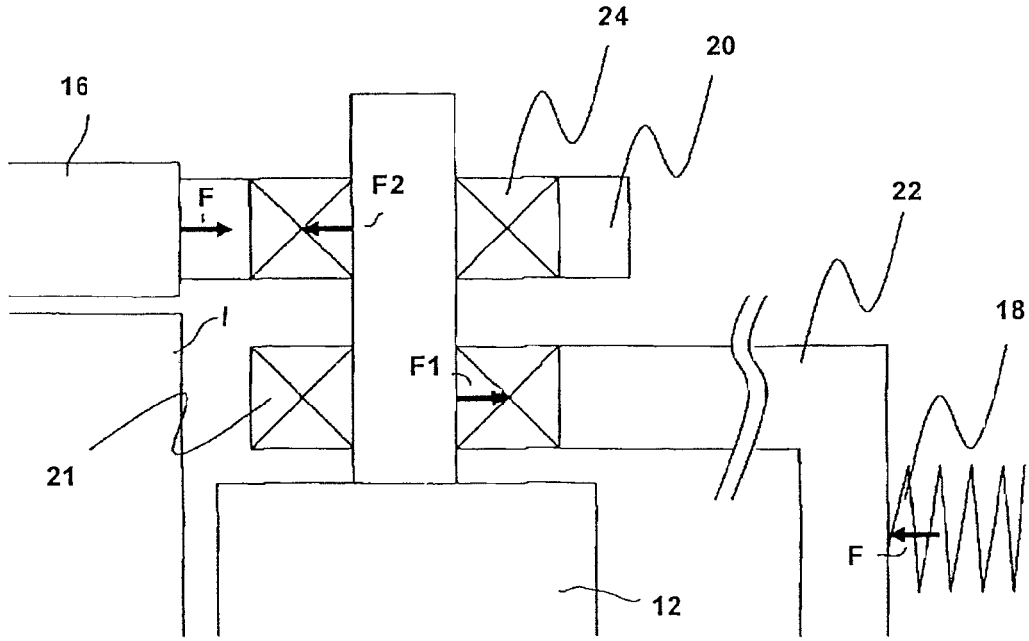
PRIOR ART FIG. 11
FIG. 11 is a diagram describing operating forces of FIG. 9.

As illustrated in FIG. 6, a portion of the developing case 22 may be the gap ensuring member. The developing case 22 has a high-precision abutted surface Sa. The abutted surface Sa abuts on the abutment block 16. The radial load does not act on the bearing 21. The number of parts can be reduced.

According to the present invention, the abutment roller which ensures the SD gap is directly pressed by the pressing unit. The stability of the SD gap and reduction of the driving load torque of the developing sleeve can be achieved to cope with both high image quality and durability. The abutment roller ensures the SD gap is directly pressed by the pressing unit. The stability of the SD gap and reduction of the driving load torque of the developing sleeve can be achieved to cope with both high image quality and durability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-242235, filed Sep. 19, 2007, which is hereby incorporated by reference herein in its entirety.

What is claimed is:

1. An image forming apparatus comprising:

an image bearing member;

a developer bearing member which is rotatable and develops a latent image formed on the image bearing member;

a developer container which contains developer that is supplied to the developer bearing member;

a supporting member which rotatably supports the developer bearing member so as not to move a relative position of the developer bearing member against the developer container;

an abutting member disposed rotatably on a rotary axis of the developer bearing member at different positions from supporting positions of the supporting member so as to form a predetermined gap between the image bearing member and the developer bearing member by abutting with abutted portions at both sides of the image bearing member; and a pressing member which directly presses the abutting member in a direction toward the abutted portions.

2. An image forming apparatus according to claim 1, wherein the abutted portions are curved surfaces concentric with the surface of the image bearing member and fixed on a main body of the image forming apparatus.

3. An image forming apparatus according to claim 1, wherein the abutted portions are portions at respective end portions of the image bearing member.

* * * * *